US006813848B2

(12) United States Patent
Ortamala

(10) Patent No.: US 6,813,848 B2
(45) Date of Patent: Nov. 9, 2004

(54) METHOD FOR PLOUGHING SNOW AND A SNOW PLOUGH

(75) Inventor: Tapio Heikki Ortamala, Pirkkala (FI)

(73) Assignee: Patria Vammas Oy, Vammala (FI)

( * ) Notice: Subject to any disclaimer, the term of this patent is extended or adjusted under 35 U.S.C. 154(b) by 7 days.

(21) Appl. No.: 10/398,406

(22) PCT Filed: Oct. 5, 2001

(86) PCT No.: PCT/FI01/00862

§ 371 (c)(1),
(2), (4) Date: Jul. 21, 2003

(87) PCT Pub. No.: WO02/29163

PCT Pub. Date: Apr. 11, 2002

(65) Prior Publication Data

US 2004/0016555 A1 Jan. 29, 2004

(30) Foreign Application Priority Data

Oct. 5, 2000 (FI) ..... 20002190

(51) Int. Cl.[7] ..... E01H 5/09
(52) U.S. Cl. ..... 37/222; 37/273
(58) Field of Search ..... 37/196, 197, 221, 37/222, 232, 272, 273, 274, 279, 280, 283; 15/340.1, 340.3, 340.4, 78, 82, 87

(56) References Cited

U.S. PATENT DOCUMENTS 2,333,361 A * 11/1943 Churchill ..... 37/273
3,199,506 A * 8/1965 Bertin et al. ..... 126/272.2 C
3,400,475 A * 9/1968 Peitl ..... 37/233

FOREIGN PATENT DOCUMENTS

EP 0 097 743 1/1984
SE 183 804 5/1963

* cited by examiner

*Primary Examiner*—Thomas B. Will
*Assistant Examiner*—Meredith Petravick
(74) *Attorney, Agent, or Firm*—Stites & Harbison PLLC; Douglas E. Jackson

(57) ABSTRACT

A method of plowing snow from a site using a snowplow with at least two plow blades (5) forming together a plowing angle and there being on the plowing site fixed objects, such as airport lamps (1), rising over the site surface. In the method, when the snowplow faces an object, the plow front end is opened and the area with the object on it is left unplowed by the open front end, with this unplowed area then being cleaned by brushes (6,7) in the rear of the plow front end.

10 Claims, 2 Drawing Sheets

METHOD FOR PLOUGHING SNOW AND A SNOW PLOUGH

BACKGROUND OF THE INVENTION

The invention relates to a method of plowing snow from a site using a snowplow furnished with at least two blades forming together at a required plowing angle, and there being on the plowing site fixed objects, such as airport lamps, rising over the site surface and smallish elevations or similar objects.

Previously known is an airport snowplow having two blades at a required angle to form a plow. The front ends of the blades are apart from one another so that a distance of 0,5–1 meters remains between their front ends. On the front side of the plow at the pointed front end, brushing devices are installed to brush forward or to the sides the lane that remains unplowed between the front ends of the plow blades. Since there is on the airport site lamps rising over its surface, plowing is carried out so that the plowing equipment is driven over the lamps from the middle, whereby the brushes clean the lamps and the unplowed lane.

The disadvantage of the above arrangement is that the brushes wear out quickly on working continuously against a rough surface. In addition, the plow is not fit for use in deep snow, since the brushes cannot move a thick layer of snow in front of the blades. Further, the plow is suited only for snow plowing, since the brush portion cannot remove ice nor any other harder material from the surface.

BRIEF SUMMARY OF THE INVENTION

The aim of the invention is to produce a better plowing result both on plowing a plain site and on plowing an obstacle, as on plowing over a light fitting. This is achieved by means of the new plowing method and snow plow as discussed below.

The advantage of the plowing method and the snowplow as per the invention is that on a site without obstacles snow plowing is carried out completely by means of the plow blades, whereby the track of plowing is even. The capacity of moving even a thick layer of snow is appreciably better than that of brush snow plows. On a site with no obstacles it is possible to plow at a higher speed, and then to decelerate at light fixtures. Thus, only when facing an obstacle does the front end of the plow is open momentarily so that cleaning is carried out by brushes. The brushes are thus long-lasting, thanks to the infrequent use thereof. Opening the front end of plow does not change the working width of the plow, and the plow can be used as a normal plow with the front end closed, when the brushes are retracted.

BRIEF DESCRIPTION OF THE DRAWINGS

In the following the invention is disclosed with reference to the enclosed drawing, where.

DETAILED DESCRIPTION OF THE PREFERRED EMBODIMENTS

Figure 1:
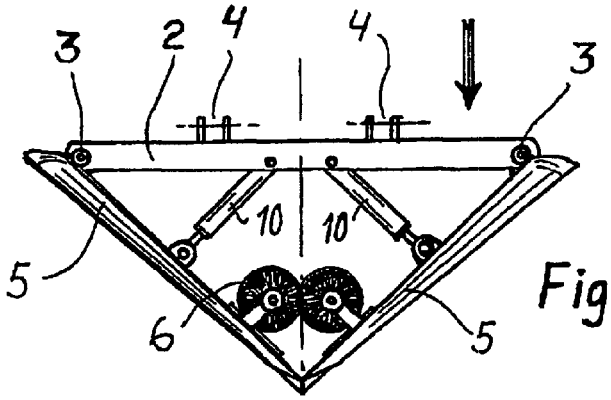
FIG. 1 shows the plow from above with the front end closed.

FIG. 1 is a plow furnished with two blades 5 which are by an articulated joint 3 fixed to the plow body 2. By means of cylinders 10, the pointed front end of the plow can be opened and closed. The plow is fixed to the working machine by means of fixing components 4 in plow body 2. The plow has brushes 6 attached to the rear end surface of blades 5. Alternatively, brushes 6 can be firmly fixed to body 2 and rotated only when the plow front end is open.

Figure 2:
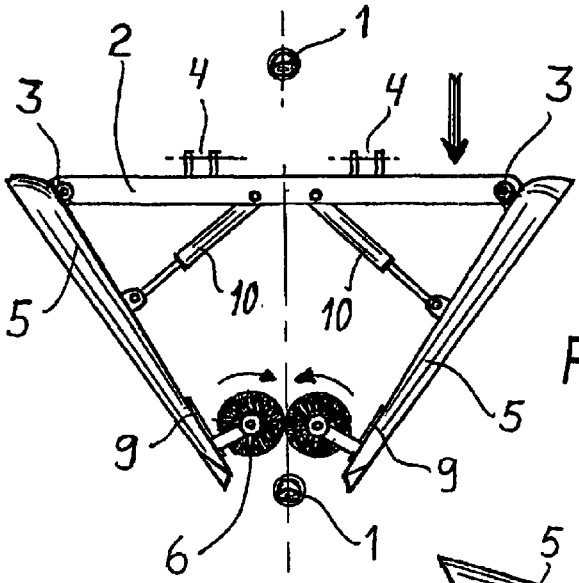
FIG. 2 shows the plow from above with the front end open.
Figure 3:
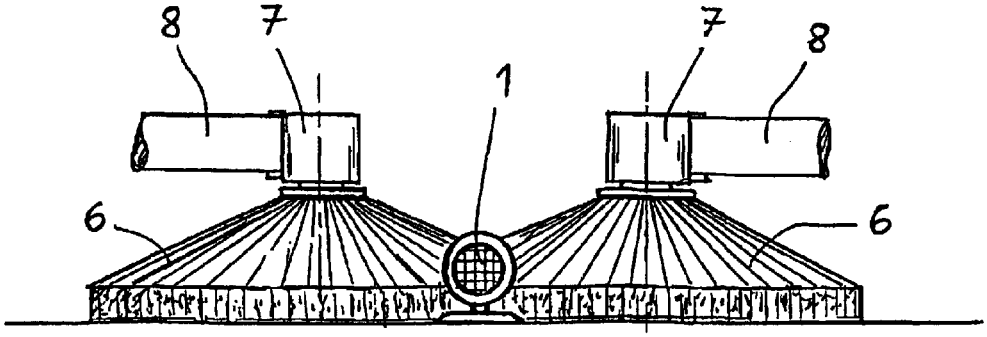
FIG. 3 shows the brush end from one side.

FIG. 2 is the plow with its front end open, whereby the blades 5 are slightly turned by cylinders 10. Rotatable brushes 6 are moved slightly forward along guides 9 on the rear surface of the blades 5. The guides 9 are, advantageously, slanting a little, whereby the brushes 6 are lower to the ground on moving towards the front ends of blades 5 and reaching the brushing position. FIG. 2 shows how a lamp 1 on the field is run over without harm by opening the plow front end and rotating the brushes 6 on the lamp. Immediately after the lamp 1, the plow front end is closed and brushes 6 are driven upward and backward. Body 2 is high enough and the working machine has sufficient ground clearance so that it is possible to drive the plow over the lamp 1. The height of airport lamps is max. 500 mm. In FIG. 3 the brush equipment is shown with lamp 1 in front of it. Brushes 6 are, by means of arms 8, attached to the back of blades 5. In the top of arms 8 there is a hydraulic motor 7 for rotating the brushes 6. The brushes 6 can have different shapes according to size and shape of lamps or other obstacles on the site.

By means of brushes 6, the aim is, in a situation as per FIG. 2, to throw the snow engaged by brushes 6 through the front end opening in large quantities to the plow front side, whereby the snow gets finally moved by means of blades 5 to the sides of the plow. There are 2 brushes 6 so that there is space for a lamp 1 between the brushes 6, when the plow runs over the lamp 1.

Figure 4:
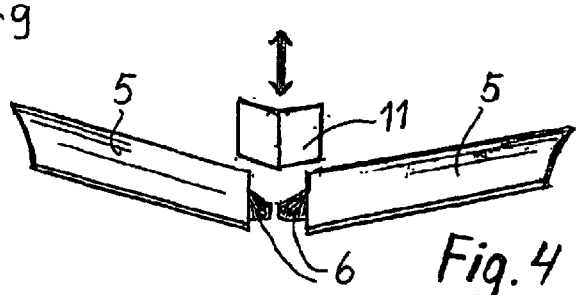
FIG. 4 shows the plow with a pointed piece that can be lifted.

In FIG. 4 an alternative solution is shown whereby, in order to open and close the plow front end, a pointed piece 11 that can be lifted up is provided. In this construction the brushes 6 can stay in place, such that the brushes 6 can be lifted from the ground when not rotated, i.e. when the pointed piece 11 is let down.

Figure 5:
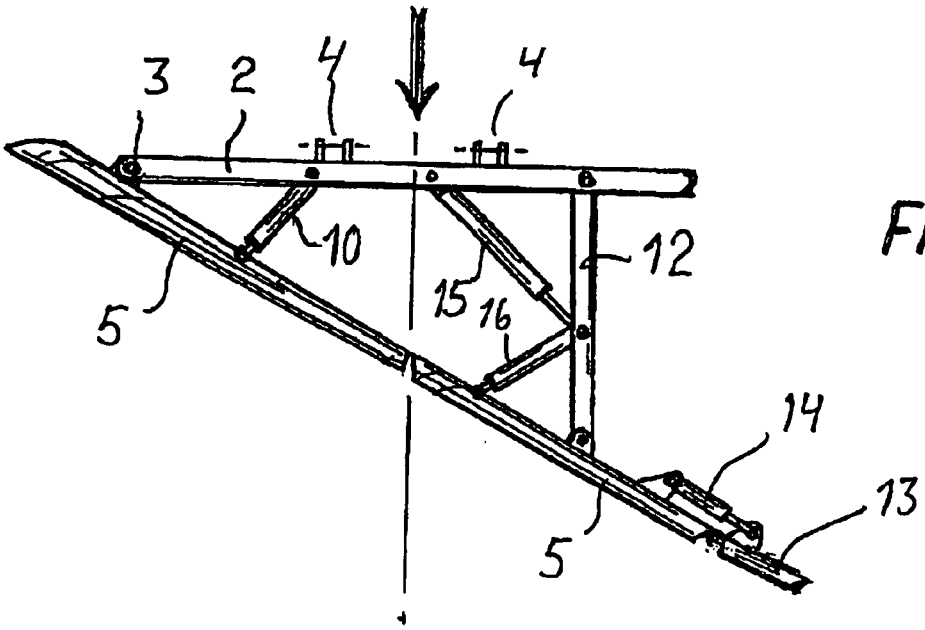
FIG. 5 shows a plow where the blades are parallel.

It is also possible to use other ways of opening the front end, such as the pointed piece in FIG. 4, which is halved into two parts so that one part is moved sideways in front of one blade and the other correspondingly moved in front of the other blade plow, whereby the plow front end is open as shown in FIG. 4. The brushes are not illustrated in this figure. Yet they are included in the equipment FIG. 5 is a plow, where blades 5 are parallel in working position. For one blade there is an auxiliary arm 12, which can be turned by means of cylinder 15. Blade 5 is turned by means of cylinder 16. There is as a blade extension an extra blade 13 turned by means of cylinder 14. The brushes are not illustrated in this figure. Yet they are included in the apparatus as shown in FIG. 6.

Figure 6:
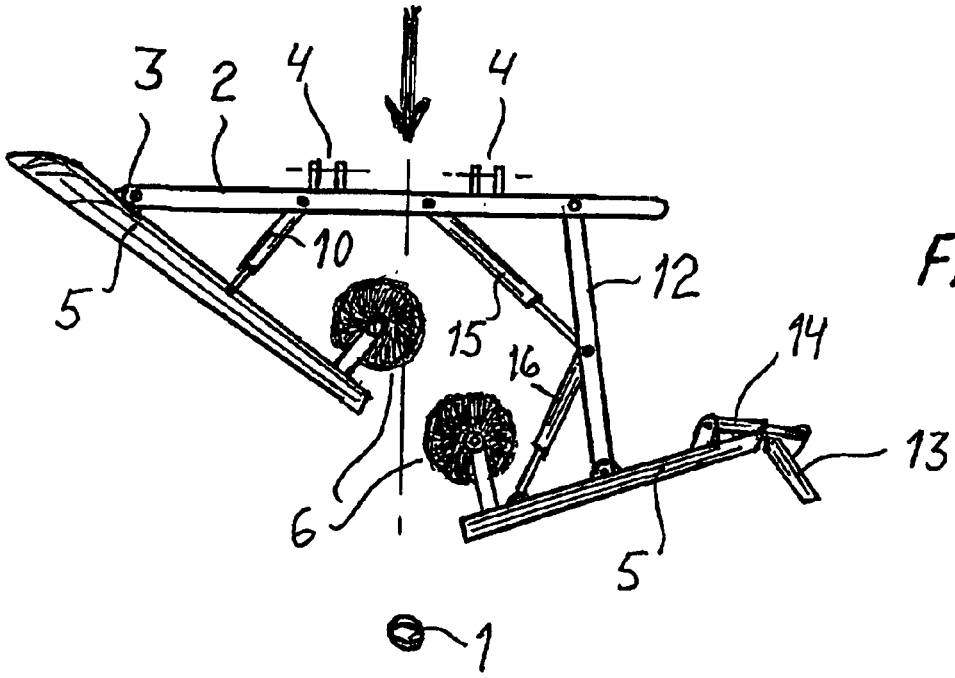
FIG. 6 shows the plow with open blades.

In FIG. 6 an example of an embodiment is presented showing how the blades are opened on hitting an obstacle. Auxiliary arm 12 is turned slightly outward. The blade 5 resting on auxiliary arm 12 is also turned for plowing a little outward, whereby snow drifts against the extra blade 13 and is turned forward for the time while the lamp is passed by and the blades 5 are again moved to the position of FIG. 5. By means of brushes 6, the place where lamp 1 is located gets cleaned on passing; while extra blade 13 prevents snow from drifting to the "wrong" side of the route.

A plow according to FIGS. 1–4 is advantageous to use also for other kinds of plowing, since it works with its front end closed as a common plow.

What is claimed is:

1. A method of plowing snow from a site using a snow plow with at least two plow blades forming together a required plowing angle and there being on the site fixed objects, rising over the site surface, said method comprising the steps of:

opening, when the snow plow faces one of the site fixed objects, space between the plow blades, and cleaning an area adjacent the object and the object, which remain unplowed due to being in the space between the plow blades, with brushes at a rear of the blades.

2. A method according to claim 1 wherein said opening the space between the plow blades step includes turning the blades about a fixed joint point.

3. A method according to claim 1 wherein said opening the space between the plow blades step includes lifting up a pointed piece.

4. A method according to claim 1 wherein said opening the space between the plow blades step includes moving blades-connecting parts in a direction of the blades.

5. A method according to claim 1 and further including the step of switching on and cleaning with the brushes only when the space is opened.

6. A method according to claim 1 and further including the step of preventing drifting of snow on a not-wanted side of the plow engagement with a turnable extra blade.

7. A snow plow, attached to a working machine by fixing components in a plow body, and furnished at least with two plow blades forming together a required plowing angle, said snow plow comprising:

a means for opening a mutual portion between the two plow blades in order to produce an unplowed lane in a space between the opened blades, and brushing equipment arranged at a rear of the blades and including brushes so that by the brushes an area with objects which has been left unplowed by the space between the blades are brushed clean.

8. A snowplow according to claim 7 wherein the blades are, from a rear end thereof, attached to the plow body by fixed joint points in order to open the space between the blades by turning the blades about the fixed joint points a power unit.

9. A snowplow according to claim 7 wherein there is, between the blades, a piece that is lifted up in order to open the space between the blades.

10. A snowplow according to claim 7 wherein there are, between the blades, blade parts movable in a direction of the blades in order to open the space between the blades.

* * * * *